United States Patent [19]

Hurst

[11] Patent Number: 4,776,523

[45] Date of Patent: Oct. 11, 1988

[54] WASTE FOOD DISPOSER

[76] Inventor: Hubert L. Hurst, 6908 Greenway Dr. North, Mobile, Ala. 36608-4214

[21] Appl. No.: 91,790

[22] Filed: Sep. 1, 1987

[51] Int. Cl.[4] ..... B02C 18/42

[52] U.S. Cl. ..... 241/46 B; 241/100.5; 241/101.2; 241/257 G

[58] Field of Search ..... 241/32.5, 42, 43, 46 A, 241/46 B, 100.5, 101.2, 257 G, 154, 199.12, 169.1

[56] References Cited

U.S. PATENT DOCUMENTS

| | | | |
|---|---|---|---|
| 2,946,522 | 7/1960 | Green | 241/32.5 |
| 3,768,744 | 10/1973 | Bebinger | 241/32.5 |
| 3,788,564 | 1/1974 | Kokorzycki | 241/46 A |
| 3,804,341 | 4/1974 | Guth | 241/32.5 |
| 3,875,461 | 4/1975 | Kiefer | 241/46 A X |
| 4,034,422 | 7/1977 | Färber et al. | 241/46 A X |
| 4,403,743 | 9/1983 | Ducasse | 241/194 |

*Primary Examiner*—Timothy V. Eley
*Assistant Examiner*—Joseph M. Gorski
*Attorney, Agent, or Firm*—Norman B. Rainer

[57] ABSTRACT

Improvements are made in a kitchen waste disposer to enhance its efficiency, reduce vibration and noise, and increase safety. The improvements include the provision of two cutting blades mounted one above the other and caused to rotate at synchronously equal speeds in opposite directions. Water injection components may be utilized to enhance the turbulence adjacent the blades and wash away debris. In preferred embodiments, an automatically deployed safety cover is associated with the top of the disposer.

3 Claims, 2 Drawing Sheets

WASTE FOOD DISPOSER

BACKGROUND OF THE INVENTION

This invention relates to waste food disposers intended primarily for use in the home and adapted for use beneath the kitchen sink. Disposers of this type are provided with a open-top housing defining a comminuting chamber. Means are provided to support the housing beneath the sink with the open top thereof aligned with the sink drain opening. In such arrangement, food waste may be placed in the sink and gradually fed into the disposer along with water.

In some types of food disposers of the aforesaid general nature, an electric motor drives an upright shaft having radially disposed cutting blades which are centered within the comminuting chamber to act upon the waste material. In order to produce effective communication, the waste material must be struck many times by the blades. This is achieved by virtue of a turbulent flow pattern within the chamber which re-circulates material to the blades. However, in many disposer designs, the centrifugal effect of the blades forms a streamlined vortex-type flow pattern which is not conducive to re-circulation. In such designs, the blades are relatively inefficient in their comminuting action.

Because of the high centrifugal force of the blades, any imbalance such as may be caused by the striking of heavy objects, will cause appreciable vibration and noise. The vibrational effects further produce excessive wear with consequent shortened life expectancy of the disposer. As a further consequence of the high centrifugal force of the blades, material is sometimes thrown upwardly out of the housing with considerable velocity.

It is accordingly a primary object of the present invention to provide a waste disposer having improved comminuting efficiency.

It is another object of this invention to provide an improved waste disposer as in the foregoing object which produces less vibration and noise during normal operation.

It is a further object of the present invention to provide an improved waste disposer of the aforesaid nature having reduced tendency to throw material upwardly out of the disposer.

It is a still further object of this invention to provide an improved waste disposer of the aforesaid nature which automatically injects water into the comminuting chamber during operation.

It is yet another object of the present invention to provide an improved waste disposer of the aforesaid nature having a closure lid which is automatically deployed upon activation of the waste disposer.

These objects and other objects and advantages of the invention will be apparent from the following description.

SUMMARY OF THE INVENTION

The above and other beneficial objects and advantages are accomplished in accordance with the present invention by improving a waste disposer having an open top housing defining a comminuting chamber substantially symmetrical about a vertical axis, an electric motor protectively positioned below said chamber and having an upwardly directed output spindle, and means for removing water and processed waste from said chamber, said improvement comprising:

(a) a gear box enclosure disposed above said electric motor, having upper and lower extremities, and receiving the output spindle of said motor through said lower extremity, (b) a central shaft extending upwardly through the upper extremity of the gear box in coaxial relationship with said chamber and having a terminal extremity disposed below the top of said housing, and a lower extremity positioned within said gear box and provided with first gear drive means coupled to the output spindle of said motor, (c) a sleeve shaft rotatively mounted upon said central shaft, having a terminal extremity disposed below the terminal extremity of said central shaft, a lower extremity positioned within said gear box above the lower extremity of said central shaft, and provided with second gear means coupled to the output spindle of said motor in a manner to rotate said sleeve shaft at the same speed as the speed of rotation of the central shaft but in the opposite rotational direction, (d) first paired cutting blades mounted in opposed relationship upon said central shaft adjacent the terminal extremity thereof and adapted to rotate in a horizontal plane, (e) second paired cutting blades mounted in opposed relationship upon said sleeve shaft below said first paired cutting blades in perpendicular relationship thereto and adapted to rotate in a horizontal plane, said second cutting blades in combination with said first cutting blades constituting counter-rotating comminuting means, (f) sealing means to prevent water in the housing from entering said gear box and motor, and (g) friction-reducing means to facilitate rotative movement of said sleeve shaft within the upper extremity of said gear box, and to facilitate counter-rotative movement between said central and sleeve shafts.

In preferred embodiments of the disposal device, the distance of separation between the planes of rotation of said first and second cutting blades is between about 1" and 1½". A moveable safety cover may be disposed adjacent the open top of the housing, and is automatically deployed when the disposal device is electrically activated. Water injection means may be employed for supplying a controlled amount of water to the housing to augment the turbulent effect produed by the counter-rotating blades, said water injection means being automatically activated with operation of the motor.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
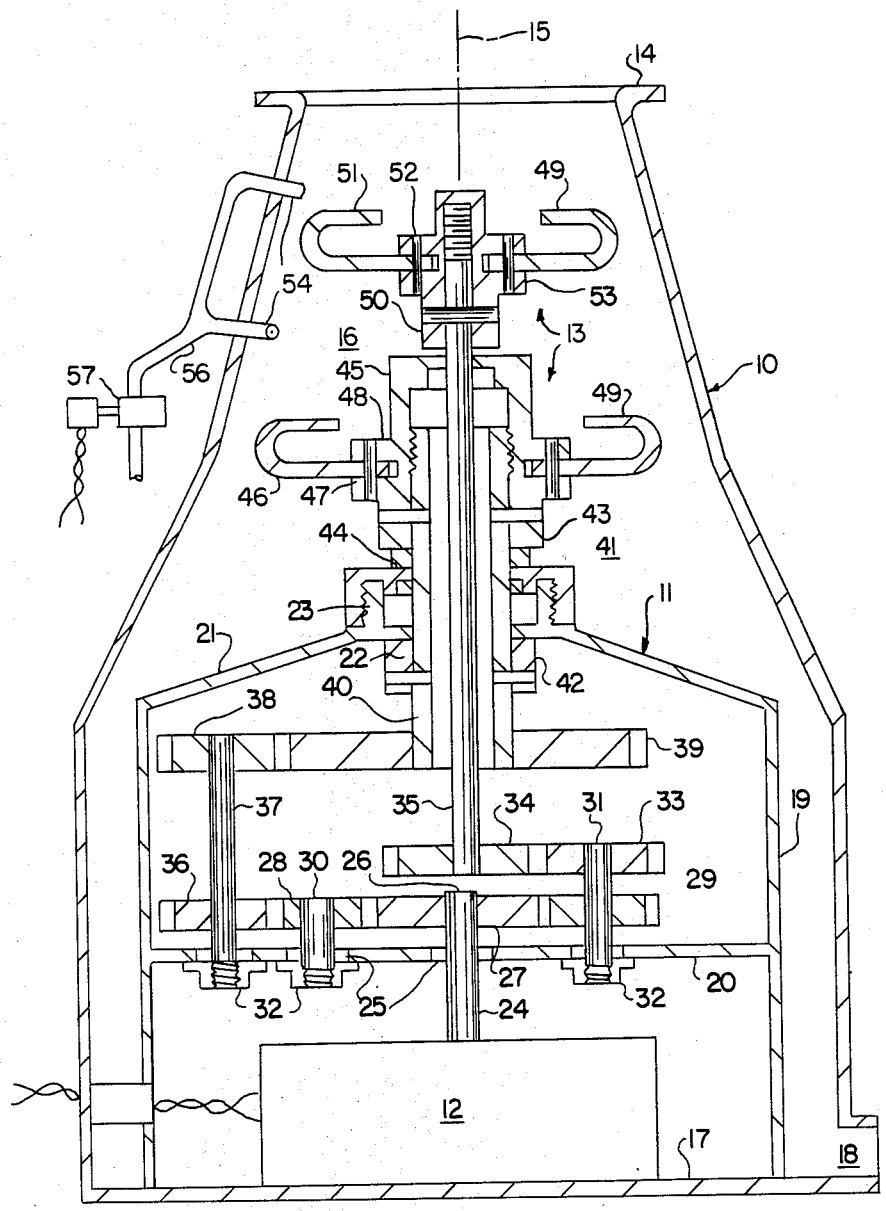
FIG. 1 is a vertical sectional view of an embodiment of the waste disposer of the present invention.

For convenience in description, the terms "upper" and "lower" , or words of similar import, will have reference to the upper and lower extremities, respectively, of the disposer as shown in FIG. 1. Similarly, the expressions "inner" and "outer" or equivalents thereof, will have reference to the geometric center of the illustrated disposer.

DESCRIPTION OF THE PREFERRED EMBODIMENT

Figure 2:
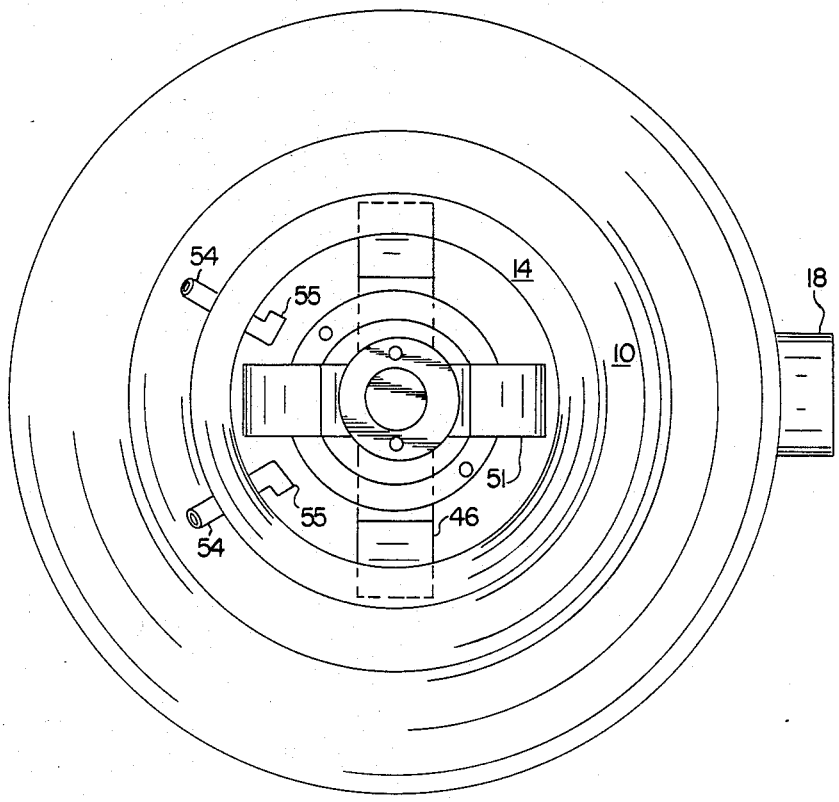
FIG. 2 is a top view thereof.

Referring to FIGS. 1 and 2, an embodiment of the waste disposer of the present invention is shown comprised of housing 10 having enclosed therein gearbox 11, motor 12 and counter-rotating comminuting means 13. Housing 10, bounded from beneath by floor panel 17, and having open circular top 14 adapted to receive waste and water, is of generally vertically elongated configuration substantially symmetrically disposed about axis 15. The upper portion of housing 10 defines a comminuting chamber 16. An exhaust port 18 is positioned in the housing adjacent floor panel 17.

The gear box is comprised of (a) cylindrical sidewall 19 defining an interior region having horizontally disposed shelf 20, (b) upper closure panel 21 having circular aperture 22 centered on axis 15, and (c) externally threaded upwardly directed tubular extension 23 centered about aperture 22.

Output spindle 24 extends upwardly from motor 12, passing through sealing bushing 25 in shelf 20, and terminating in upper extremity 26 disposed within the gear box. A first drive gear 27, of straight tooth spur gear configuration, is perpendicularly affixed to spindle 24 adjacent extremity 26. Gear 27 enmeshes laterally with gears 28 and 29 mounted upon shafts 30 and 31, respectively, said shafts being journaled to shelf 20 through sealing bushings 25, and secured from below by flanged locknuts 32.

Gear 33 is positioned at the upper extremity of shaft 31 in enmeshing relationship with gear 34 perpendicularly affixed to the lowermost extremity of central shaft 35. Gear 36, mounted upon shaft 37 which is journaled to shelf 20, laterally meshes with gear 28. The upper extremity of shaft 37 supports gear 38 which meshes laterally with gear 39 perpendicularly affixed to sleeve shaft 40 concentrically disposed upon central shaft 35. By virtue of the aforesaid arrangement of shafts and gears, it is seen that central shaft 35 and sleeve shaft 40 are caused to be rotated in opposite directions. The diameters and tooth counts of the several gears are selected to impart equal rotational velocities to sleeve shaft 40 and central shaft 35.

Sleeve shaft 40, of tubular configuration, is journaled to upper panel 21 by passage through lower end cap sealing bushing 41 which threadably engages tubular extension 23. Upward movement of sleeve shaft 40 is prevented by shoulder bushing 42 attached to shaft 40 and in abutment with the underside of upper ppanel 21. Downward movement of shaft 40 is prevented by shoulder 43 attached to shaft 40 and resting upon frictionless washer 44 which in turn rests upon lower end cap 41.

Upper end cap 45 threadably engages the exterior of the uppermost extremity of shaft 40. A lower pair of cutting blades 46 are attached in opposed relationship to shaft 40 by means of bolts 47 which pass through holes in the blades and through vertically aligned threaded holes in flanged base 48 of upper end cap 45 and shoulder 43. Blades 46 have a substantially U-shaped configuration which directs their cutting edges 49 inwardly toward axis 15. Other blade configurations can, however, be employed.

Downward movement of central shaft 35 is prevented by flanged collar 50 attached to shaft 35 and which abuts against upper end cap 45. An upper pair of cutting blades 51 are attached in opposed relationship to shaft 35 by means of bolts 52 which pass through holes in the blades and through vertically aligned threaded holes in collar 50 and in the flange 53. Cutting blades 51 are of the same general configuration as cutting blades 46 except that the directions of orientation of the cutting edges are reversed. Also, the distance of radial extension of the upper blades from axis 15 may be less than the corresponding distance for the lower blades.

For purposes of illustration, the upper and lower pairs of cutting blades are shown in FIG. 1 in vertically aligned relationship. However, in their correct positions, as shown in FIG. 2, the blades of one pair are disposed 90 degrees apart from the blades of the other pair. The distance of separation between the cutting edges 49 of the two pairs of blades is preferably between 1" and 1½". With said separation, it has been found that the counter-rotational motion of the blades in combination with their constant 90 degree angular separation produces an efficient comminuting effect.

A tubular metal water conduit 54 having a circular perimeter is attached to the interior wall of comminuting chamber 16. A series of uniformly spaced apart apertures 55 in conduit 54 are directed toward the interior of the chamber. Conduit 54 is supplied with water from a supply tube 56 that penetrates housing 10. A solenoid activated valve 57 associated with supply tube 56 controls the flow of water to conduit 54. When the disposer is electrically activated to start motor 12, valve 57 is simultaneously opened. Such action produces a uniform spray of water from conduit 54 which is directed into the region between the cutting blades. The effect of the water spray is to further enhance the efficiency of comminution.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. In a waste disposer having an open top housing defining a comminuting chamber substantially symmetrical about a vertical axis, an electric motor protectively positioned below said chamber and having an upwardly directed output spindle, and means for removing water and processed waste from said chamber, the improvement comprising:

(a) a gear box enclosure disposed above said electric motor, having upper and lower extremities, and receiving the output spindle of said motor through said lower extremity, (b) a central shaft extending upwardly through the upper extremity of the gear box in coaxial relationship with said chamber and having a terminal extremity disposed below the top of said housing, and a lower extremity positioned within said gear box and provided with first gear drive means coupled to the output spindle of said motor, (c) a sleeve shaft rotatively mounted upon said central shaft, having a terminal extremity disposed helow the terminal extremity of said central shaft, a lower extremity positioned within said gear box above the lower extremity of said central shaft, and provided with second gear means coupled to the output spindle of said motor in a manner to rotate said sleeve shaft at the same speed as the speed of rotation of the central shaft but in the opposite rotational direction, (d) first paired cutting blades mounted in opposed relationship upon said central shaft adjacent the terminal extremity thereof and adapted to rotate in a horizontal plane, (e) second paired cutting blades mounted in opposed relationship upon said sleeve shaft below said first paired cutting blades and adapted to rotate in a horizontal plane, said second cutting blades in combination with said first cutting blades constituting counter-rotating comminuting means, (f) sealing means to prevent water in the housing from entering said gear box and motor, and (g) friction-reducing means to facilitate rotative movement of said sleeve shaft within the upper extremity of said gear box, and to facilitate counter-rotative movement between said central and sleeve shafts.

2. The improved waste disposer of claim 1 wherein the distance of separation between the planes of rotation of said first and second cutting blades is between about 1 inch and 1½ inches.

3. The waste disposer of claim 2 including water injection means which supply a controlled amount of water to the housing to augment the turbulent effect produced by the counter-rotating blades, said water injection means being automatically activated with activation of the motor.

* * * * *